US007484974B2

(12) United States Patent
Wu

(10) Patent No.: US 7,484,974 B2
(45) Date of Patent: Feb. 3, 2009

(54) CARD CONNECTOR

(75) Inventor: Min-Fang Wu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/644,917

(22) Filed: Dec. 21, 2006

(65) Prior Publication Data

US 2007/0141879 A1 Jun. 21, 2007

(51) Int. Cl.
*H01R 13/62* (2006.01)

(52) U.S. Cl. ..... 439/159

(58) Field of Classification Search ..... 439/159, 439/607, 64; 411/369, 174, 181, 112, 180
See application file for complete search history.

(56) References Cited

U.S. PATENT DOCUMENTS 6,050,852 A * 4/2000 Wu ..... 439/607
6,059,588 A 5/2000 Tung et al.
6,109,849 A * 8/2000 Nagayama ..... 411/181
6,193,553 B1 * 2/2001 Yu ..... 439/607
6,357,980 B1 * 3/2002 Lansinger ..... 411/174
7,241,097 B2 * 7/2007 Dembowsky et al. ..... 411/369
2005/0287855 A1 * 12/2005 Taguchi ..... 439/159

* cited by examiner

*Primary Examiner*—Alexander Gilman
(74) *Attorney, Agent, or Firm*—Wei Te Chung

(57) ABSTRACT

A card connector comprises an insulating housing, a plurality of contacts retained in the insulating housing and a shell. The shell covers the insulating housing to define a card receiving space therebetween and defines a card insertion/ejection direction. The contacts comprise a plurality of contact portions exposed into the card receiving space and a nut rivets on the shell. Thus, the card connector is mounted on a PCB securely.

10 Claims, 6 Drawing Sheets

CARD CONNECTOR

BACKGROUND OF THE INVENTION

1. Field of the Invention

The present invention is generally related to card connectors, and more particularly, to a card connector which can be securely mounted on a printed circuit board (PCB).

2. Description of Related Art

With the development of electronic appliances, different electrical cards are used to expand additional functions of the electronic appliance, such as data storage. A card connector is required to receive the electrical card to achieve the storage function between the electrical card and the corresponding electronic appliance. In order to assure stability of signal transmission between the card and the corresponding electronic appliances, the card connector is required to be mounted on a PCB securely and conveniently.

U.S. Pat. No. 6,059,588 discloses a card connector, which comprises an insulating housing, a plurality of contacts received in the housing, a shell covering the housing and an ejector. The insulating housing defines a through hole and the shell has a corresponding hole. When the card connector is mounted on a PCB, a nut passes through the hole of the shell and the through hole of the insulating housing to secure the card connector on the PCB. However, because diameter of the hole of the shell is larger than that of the nut, it is possible the nut will loose after a certain time gone so that the card connector cannot be mounted securely. In this situation, it is certain to affect stability of signal transmission.

Hence, an improved card connector is required to overcome the disadvantages of the related art.

SUMMARY OF THE INVENTION

Accordingly, an object of the present invention is to provided a card connector which can be mounted on a PCB securely.

To achieve the above objects, a card connector comprises an insulating housing, a plurality of contacts retained in the insulating housing and a shell. The shell covers the insulating housing to define a card receiving space therebetween and defines a card insertion/ejection direction. The contacts comprise a plurality of contact portions exposed into the card receiving space and a nut rivets on the shell.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
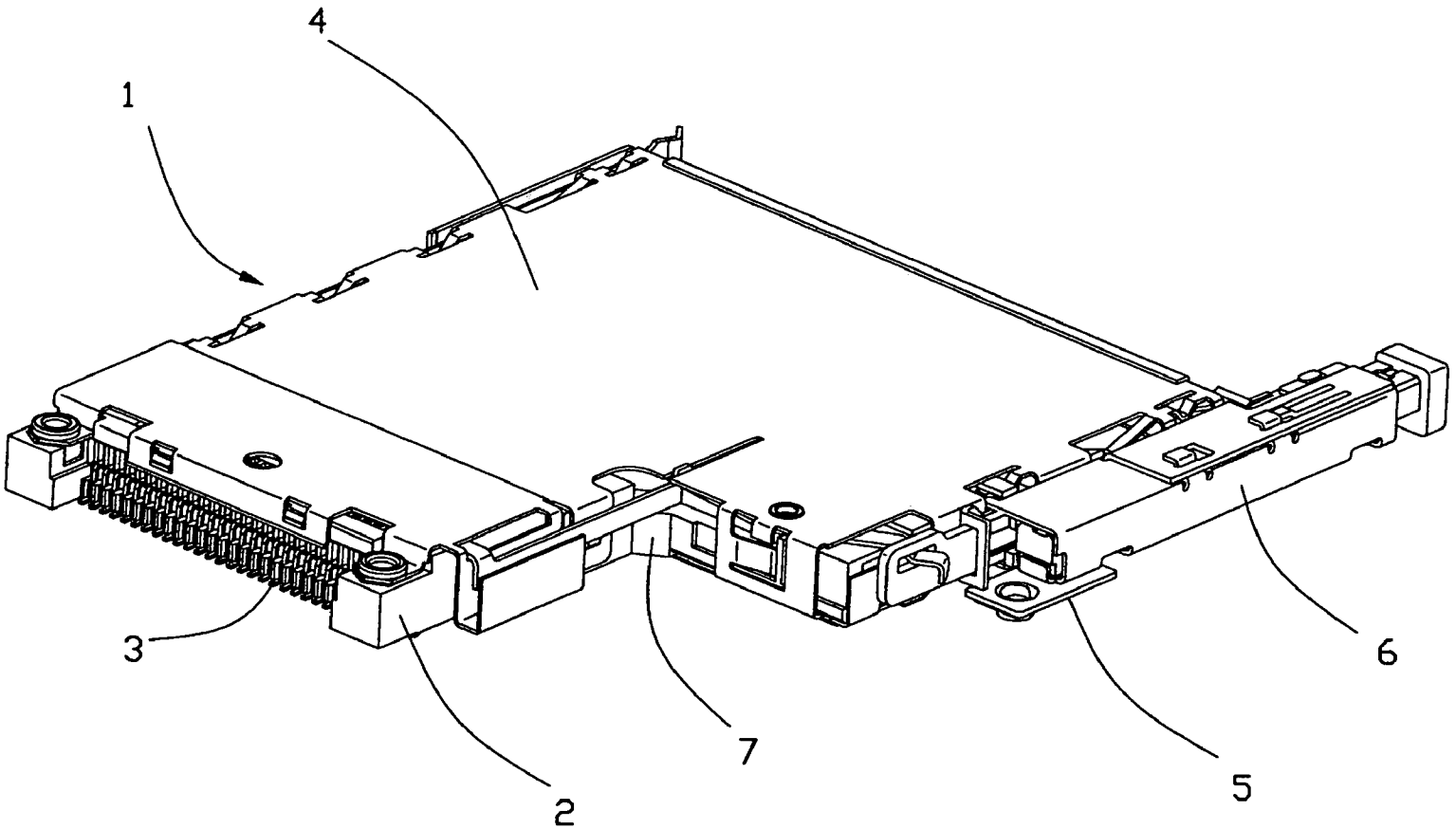
FIG. 1 is an assembled, perspective view of the card connector in accordance with the present invention.
Figure 2:
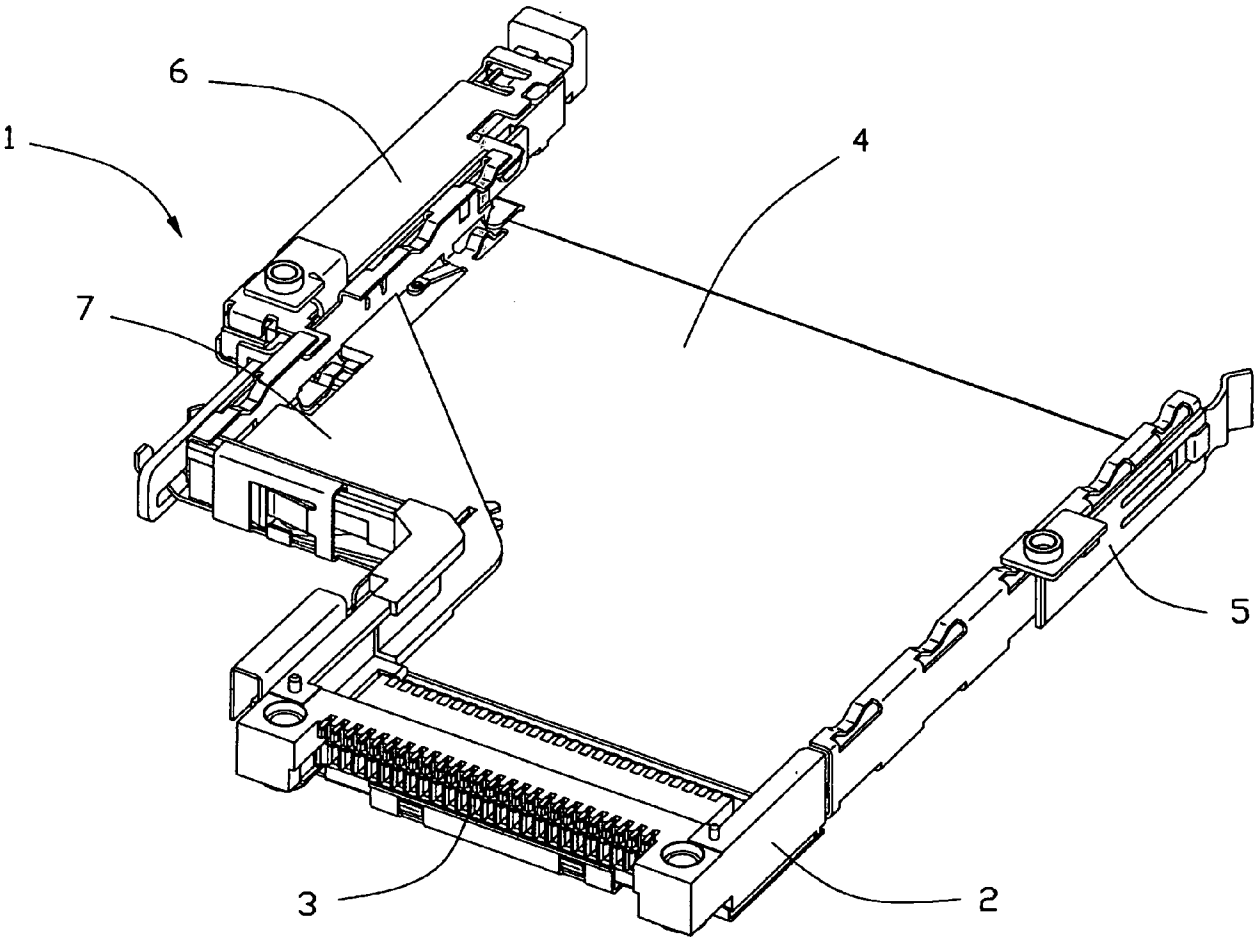
FIG. 2 is an assembled, perspective view similar to FIG. 1, but taken from another aspect and without a bottom plate.

Referring to FIG. 1, a card connector 1 in accordance with the present invention is approximately L-shaped. The card connector 1 comprises an elongated insulating housing 2 with a plurality of contacts 3 being received in, a L-shaped shielding 4 covering the housing 1, a pair of standoffs 5, an ejector 6 disposed on the shielding 4, a guide element 7 and a bottom plate 8 assembled to the shell 4 with stabs 80 mating with the shell 4.

Figure 3:
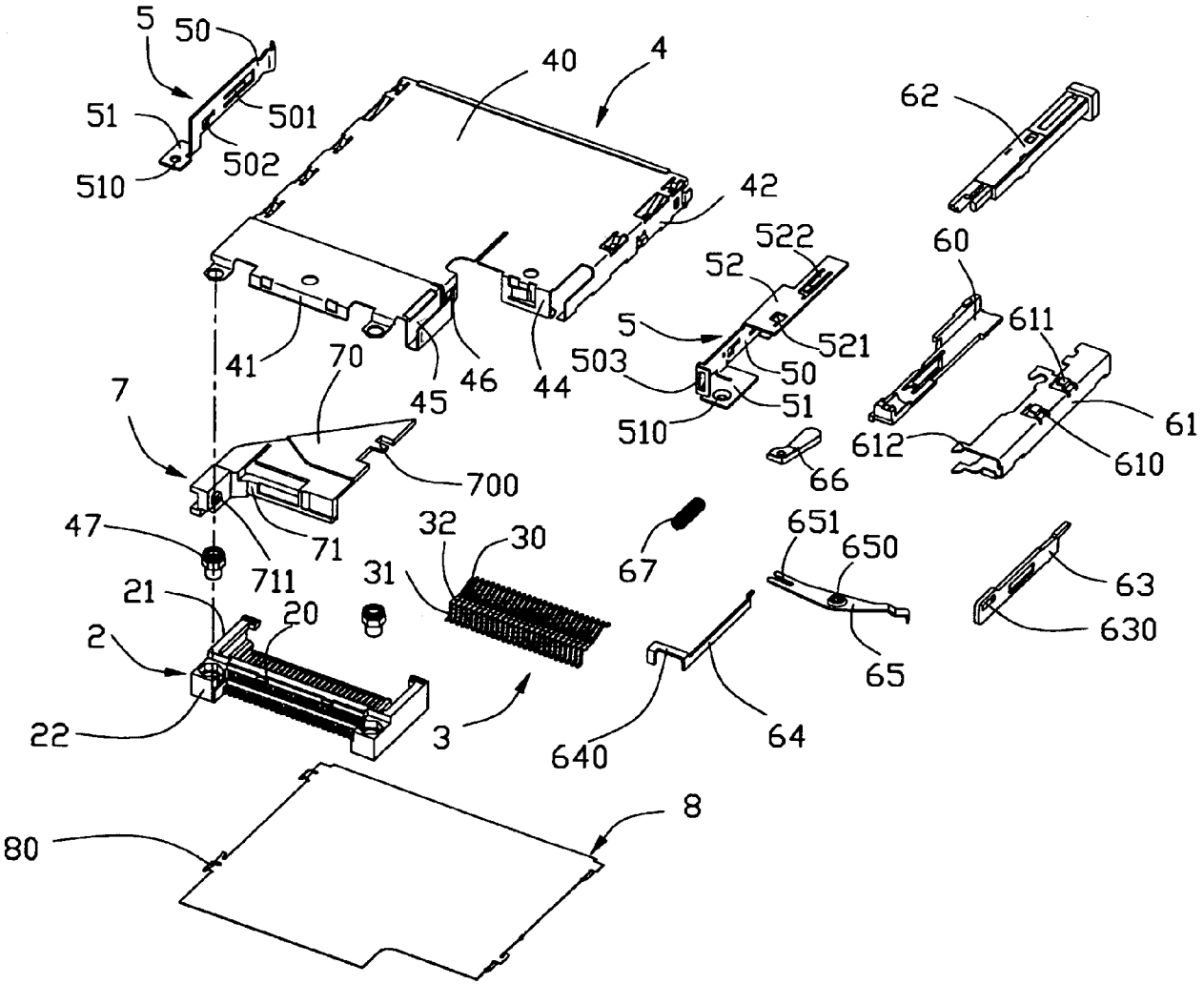
FIG. 3 is an exploded, perspective view of the card connector of FIG. 1.
Figure 4:
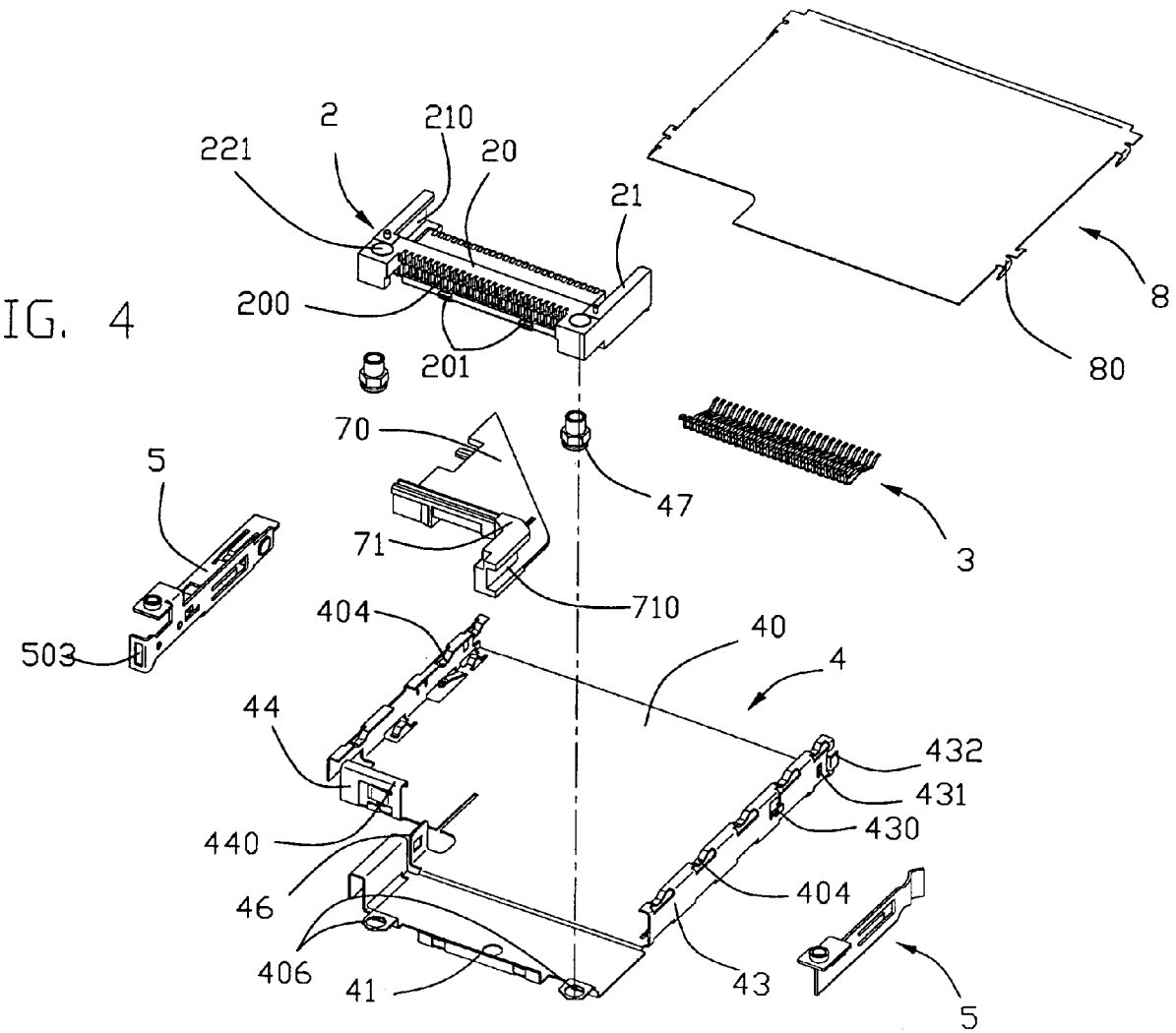
FIG. 4 is a partially exploded, perspective view similar to FIG. 3 with an ejector not shown.

Referring to FIGS. 3 and 4, the elongated insulating housing 2 has a base 20, a pair of guiding arms 21 and a pair of protrusions 22 extending backwardly and forwardly from opposite sides of the base 20 respectively and a mating portion (not labeled) extending from a lower part of the base 20 and disposed between the two guiding arms 21. The protrusions 22 define a pair of column holes 221 with upper portions 220 being hexagon. The base 20 is formed with a pair of wedges 201 at an upper face thereof. The contacts 3 are received in a plurality of parallel channels 200 formed in the mating portion. Each contact 3 comprises a contact portion 30 for electrically connecting with card, a tail portion 31 for electrically connecting with a printed circuit board and a fixing portion 32 connecting the contact portion 30 and the tail portion 31.

Figure 5:
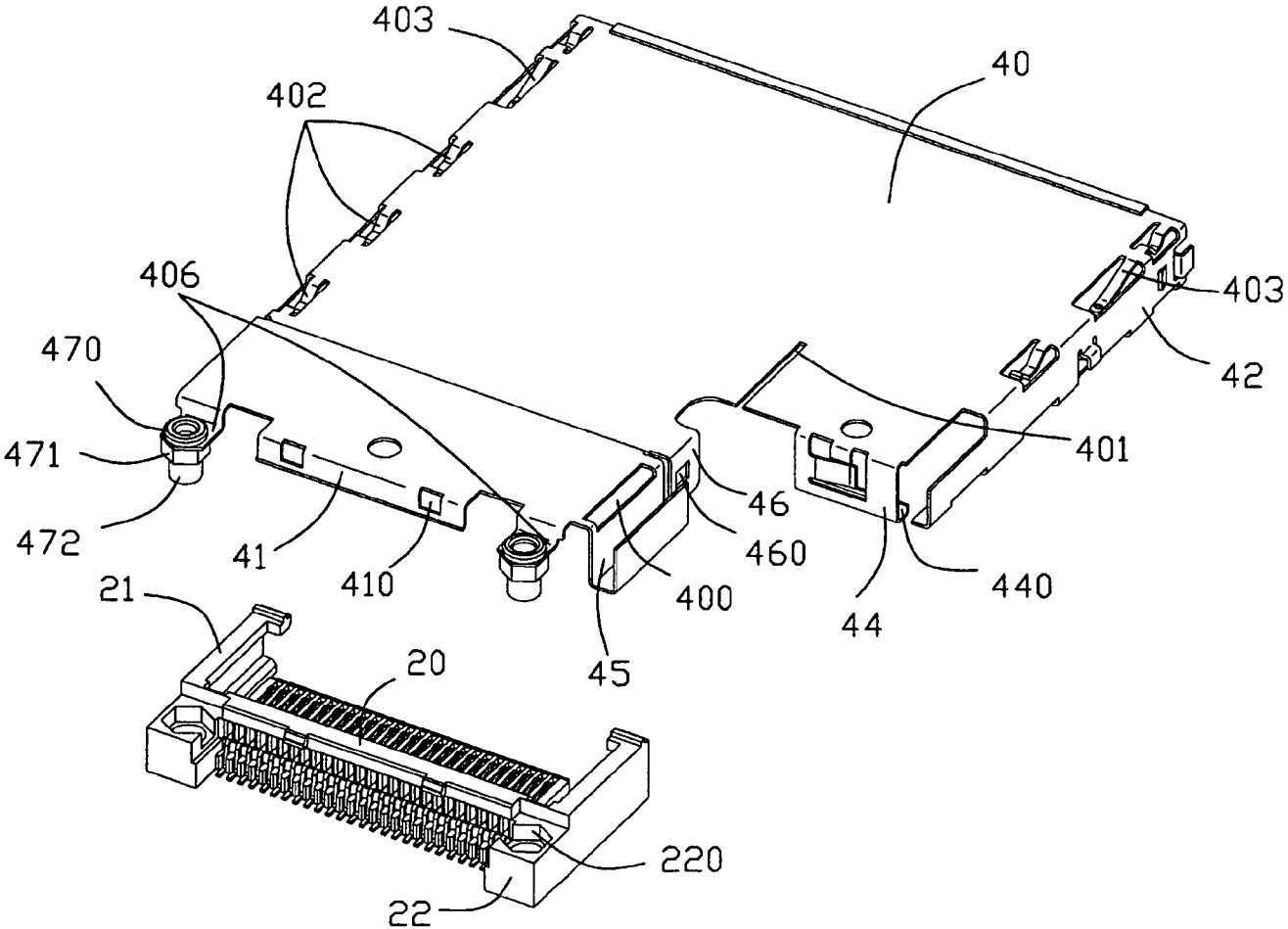
FIG. 5 is a partially assembled, perspective view of the card connector of FIG. 4.

Referring to FIGS. 3 to 5, the shielding 4 coupled on the housing 2 is formed and stamped a metallic sheet. The shielding 4 has a main body 40 in L-shaped and a plurality of side edges extending downwardly from edges of the main body 40 to form a card receiving space (not labeled) with an card inserting opening (not labeled) for accommodating cards cooperating with the main body 40 and defines a card insertion/ejection direction. That is, width of one part of the shield adjacent to the housing is wider than that of an opposite part thereof adjacent to the card-inserting opening along a transverse direction. These side edges comprise a front wall 41 extending downwardly from a front edge of the main body 40, a first and a second side edges 43, 45 at opposite sides of the front wall 41, a third side edge 42 disposed in the same side with the second side edge 45 and a longitudinal side edge 44. The first and the second side edges 43, 45 are respectively adjacent to opposite ends of the front wall 52 and the longitudinal side edge 44 is disposed between the second side edges 45 and the third side edge 42. The main body 40 has a tab 46 with a mating hole 460 thereon and extending downwardly therefrom and locating behind the second side edge 45. The first and third side edges 43, 42 are provided with horizontal slices (not labeled) extending inwardly to the card receiving space from hemlines thereof respectively. A plurality of convex portions 402 and resilient slices 403 are formed on the main body 40 adjacent to the second and the third side edges 43, 42 for positioning the card in an up and down sides. A pair of locking holes 410 receives the corresponding wedges 210 of the base 20. The longitudinal side edge 44 is bended backwardly from a hemline thereof to form a receive portion (not labeled) with a spring arm extending therein for holding the guide element 7. A slot 401 is formed on the main body 40 at a corner between the longitudinal wall 44 and the tab 46 along the card ejection direction. The second side edge 45 is U-shaped with an upward opening.

Referring to FIGS. 3 to 4, the guider element 7 is approximately in a triangle shape. The guider element 7 has a board 70 and a L-shaped perpendicular wall 71 extending forwardly and downwardly from a front end of the board 70. The board 70 is received in the receive portion of the longitudinal side edge 44 and abuts against the second side edge 42. The perpendicular wall 71 has a wedge 711 received in the mating hole 460 of the tab 46 and the spring arm of the longitudinal wall 44 abuts against a longitudinal outer face of the perpendicular wall 71 to hold the guide element 7 on the shell 4. The perpendicular wall 71 defines a guide channel 710 towards the card receiving space for guiding the card inserting into or ejecting out of the card connector 1. The board 70 defines a second slot (not labeled) in alignment with the slot 401 of the shell 4 and a protruding block 700 engaging with the shell 4.

Referring to FIGS. 3 and 4, the stand offs 5 and have a right and a left stand off. Each stand off has a flake 50 and a soldering piece 51 horizontally extending from a lower portion of a front end of the flake 50. A cutout 502 and a resilient piece 501 are formed on the flake 50 and a through hole 510 is formed on the soldering piece 51. The right stand off has a holding portion with a holding hole 503 therein formed at a front end thereof and a locking piece 52 extending outwardly from an upper portion thereof. A second cutout 521 and a second resilient piece 522 are formed on the locking piece 52. The stand offs 5 are assembled to the shell 4 with the aid of the cutouts 502 and the resilient pieces 501 thereof engaging with a locking tab 430 and a protrusion 431 of the shell 4.

The ejector 6 comprises a push rod (not labeled) having an actuator 62, a positioning piece 60, a cam follower 66, a shell flame 61 and a spring 67, and a sliding piece 63, a pivoting piece 65 and a ejecting rod 64. The push rod is known to one ordinary skill in the art. Thus, details of the push rod will not be illustrated. The shell flame 61 has a pair of locking pieces 610, 611 to mate with the second cutout 521 and the second resilient piece 522 to make the push rod be assembled on the right stand off 5. The pivoting piece 65 has a pivoting portion 650 in middle portion thereof to be pivotally received in a pivoting hole (not labeled) of the shell 4. A rear end of the sliding piece 63 is received in the push rod moveably. One end of the pivoting piece 65 is received in a rectangular hole 630 of the sliding piece 63 and the other end 651 connects with a rear end of the ejecting rod 64. The ejecting rod 64 can move in the U-shaped side edge 45 and in the slot 401 of the shell 4 with the movement of the pivoting piece 65 actuated by the push rod. A front end 640 extends into the card receiving space to eject the card.

Figure 6:
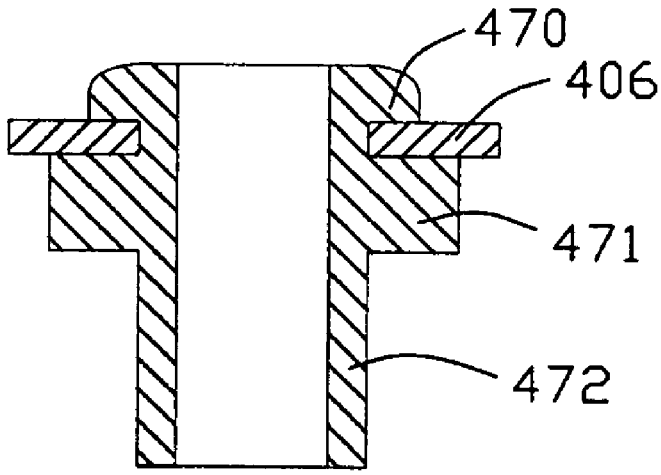
FIG. 6 is a sectional view of a nut/riveting piece assembly shown in FIG. 5 constructed in accordance with the present invention.

Referring to FIGS. 3-5, the front end of the main body 40 has a pair of riveting pieces 406 symmetrically arranged besides the front wall 41 of the shell 4. Each riveting piece defines a riveting hole (not labeled) in alignment with the column bole 221 of the housing 2. Furthermore, the card connector 1 has a nut 47 (a riveting nut in this embodiment). The nut 47 has a riveting portion 470, a hexagon screw cap 471 and a screw column 472. Each riveting piece is flat allowing the nut to be riveted conveniently. When assembled to the housing 2, the riveting portion 470 rivets in the riveting hole of the shell 4, the screw column 472 is received in the column hole 221 with the screw cap 471 fitting into the corresponding hexagon upper portion 220. In this situation, the riveting piece is sandwiched by the riveting portion 470 and the screw cap 471, and the riveting portion 470 locks in the riveting hole securely without looseness. Therefore, in any event the nut 47 cannot release from the shell 4 if not destructing. On the other hand, the screw cap 471 mates with the upper portion 220 fitly so that the nut 47 cannot rotate in the column hole 221. Thus, the nut 47 can make the card connector 1 mount on a PCB securely to assure stability of the signal transmission. More detailed description about how the riveting piece 406 is assembled with the nut is shown in FIGS. 5, 6. The riveting piece 406 is sandwiched by the riveting portion 470 and the screw cap 471 of the nut, and the screw column 472 is extending from the screw cap 471 backwardly from the riveting portion 470.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector comprising:

an insulating housing;

a plurality of contacts retained in the insulating housing;

a shell covering the insulating housing and to define a card receiving space therebetween and defining a card insertion/ejection direction, the contacts comprising a plurality of contact portions exposed into the card receiving space; and a nut riveting on the shell, comprising a riveting portion passing through a hole on the shell and riveted on the shell, a column portion extending into the insulating housing, and a screw cap connecting the riveting portion and the column portion;

wherein the shell has a riveting piece which is sandwiched by the riveting portion and the screw cap of the nut.

2. The card connector as claimed in claim 1, wherein the insulating housing defines a hole to receive the column portion and the hole has a polygon upper portion to receive the screw cap.

3. The card connector as claimed in claim 2, wherein the polygon upper and the screw cap are hexagon configurations, respectively.

4. The card connector as claimed in claim 1, wherein the shell is approximately L-shaped.

5. The card connector as claimed in claim 4, further comprising an L-shaped bottom plate is assembled to the shell.

6. The card connector as claimed in claim 1, further comprising an ejector assembled to the shell.

7. The card connector as claimed in claim 6, wherein the ejector comprises a push rod, a sliding piece with one end disposed in the push rod moveably, an ejecting rod to eject a card and a pivoting piece connecting the sliding piece with the ejecting rod.

8. The card connector as claimed in claim 7, wherein the ejecting rod moves along a direction parallel to the card insertion/ejection direction.

9. a card connector comprising:

an insulating housing defining a nut hole;

a shell assembled to the insulating housing;

the insulating housing and the shell commonly defining a card receiving space;

a plurality of contacts retained in the insulating housing;

the contacts comprising a plurality of contact portions exposed into the card receiving space; and a nut independently riveting on the shell and extending into the nut hole, wherein the nut includes a screw column, a screw cap commonly embedded within the nut hole; wherein the nut further includes a riveting portion located on the screw cap opposite to the screw column, and said shell essentially sandwiched between the riveting portion and the screw cap.

10. The card connector as claimed in claim 9, wherein said screw column is much longer than the riveting portion along an axial direction of said nut.

* * * * *